United States Patent [19]

Bilyeu

[11] 3,951,413

[45] Apr. 20, 1976

[54] GOLF CLUB DRIVER WITH CENTER OF GRAVITY MOVABLE DURING SWING

[76] Inventor: Bill Bilyeu, 3002 SW. Blvd., Sedalia, Mo. 65301

[22] Filed: May 20, 1974

[21] Appl. No.: 471,572

[52] U.S. Cl. ..... 273/170

[51] Int. Cl.[2] ..... A63B 53/08

[58] Field of Search ..... 273/77 R, 170, 171

[56] References Cited

UNITED STATES PATENTS

| | | | |
|---|---|---|---|
| 1,561,595 | 11/1925 | Davis | 273/170 |
| 2,098,445 | 11/1937 | Wettlaufer | 273/170 |
| 2,124,534 | 7/1938 | Barnhart | 273/170 X |
| 3,199,874 | 8/1965 | Blasing | 273/170 |

FOREIGN PATENTS OR APPLICATIONS

| | | | |
|---|---|---|---|
| 407,983 | 3/1934 | United Kingdom | 273/170 |

*Primary Examiner*—Richard J. Apley
*Attorney, Agent, or Firm*—Laurence R. Brown

[57] ABSTRACT

A golf club head has a hollow passageway partly filled with mercury oriented so that it will shift position and therefore change the balance and center of gravity of the club during a golfer's swing. The passageway provides for a shift of weight toward the toe of the head as the torque of a golfer's swing increases.

2 Claims, 4 Drawing Figures

GOLF CLUB DRIVER WITH CENTER OF GRAVITY MOVABLE DURING SWING

This invention relates to golf clubs and more particularly it relates to drivers commonly known as woods.

A driver in general has a long shaft that requires a swing to take an arcuate path to meet a ball placed a distance in front of the golfer. Motion over this path introduces a torque during the swing which tends to twist the head position away from a square contact with the ball. Thus, a golfer must develop a swing that controls the club by tempo, speed and grip to address the ball squarely. Accordingly it requires a high degree of skill to address a ball properly with a wood or driver.

It is therefore an object of the invention to provide an improved club with automated control over the torque developed during a swing.

In accordance with a preferred embodiment of the invention therefore, a charge of mercury is placed in a passageway within the club head oriented in such a way that the mercury changes position to counterbalance the torque developed during the swing thereby making it easier to control the club for squarely addressing the ball.

Other features, objectives and advantages will be found throughout the following description which refers to the accompanying drawing, wherein ...

Figure 1:
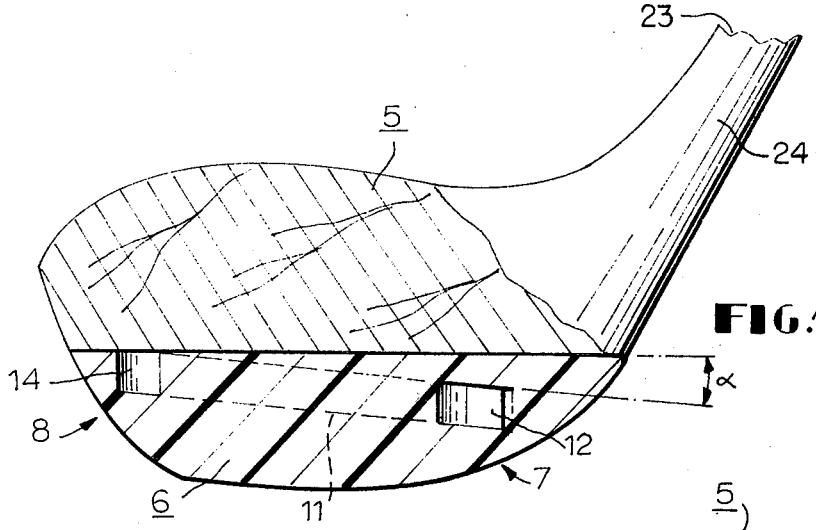
Figure 2:
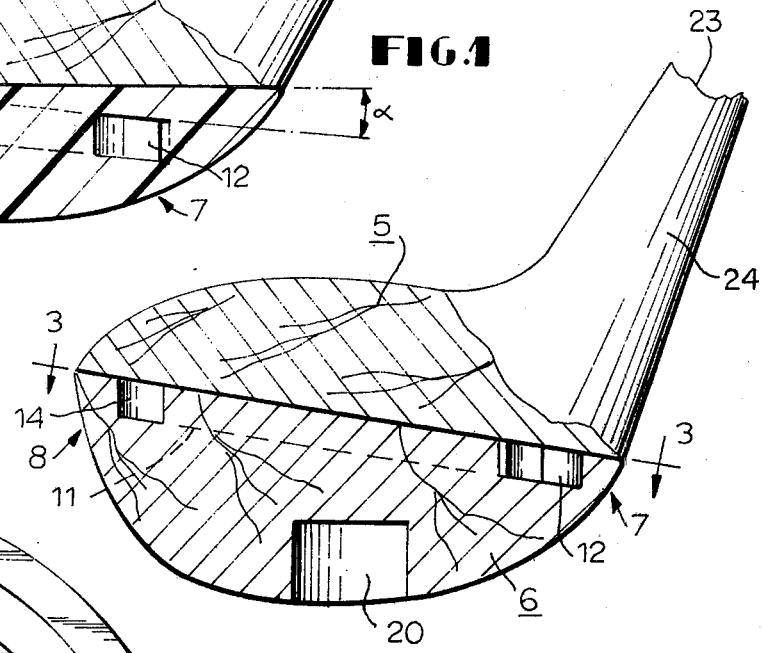
Figure 3:
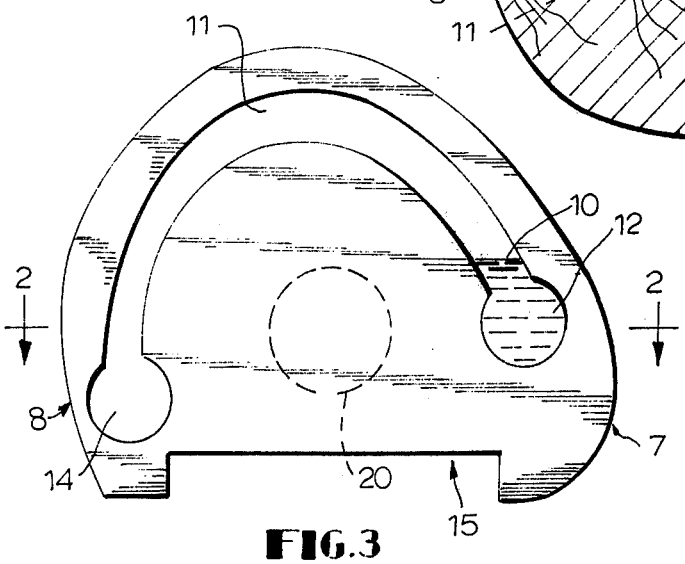
Figure 4:
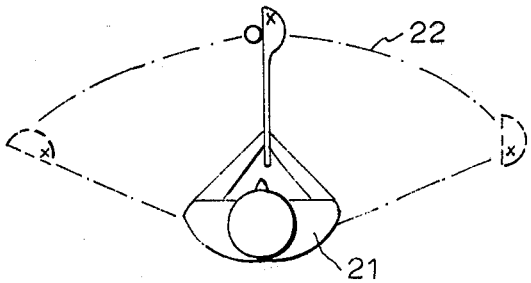

FIGS. 1 and 2 are broken away views partly in section of two embodiments of the head of a golf club driver commonly called a wood, FIG. 3 is a top plan view of the lower portion of a head as shown in FIG. 2 along lines 3—3, and FIG. 4 is a plan sketch showing the path a driver takes in use.

As may be seen from FIGS. 1 and 2 a driver or wood has a head comprised of an upper section 5 that may be of wood and a lower section 6 that may be of wood or plastic. Each head is aligned on a shaft 23 with a heel section 7 in approximate alignment with the shaft and a toe section 8 most remote from the shaft.

In accordance with this invention means is provided within the head to change position during a driving stroke to change the balance of the head by moving the center of gravity. While means such as a spring loaded weight might be used, a preferred embodiment has a charge of mercury 10 which can move from position to position within the head while confined in a passageway 11.

As may be seen from FIG. 3 a recess 15 is provided for receiving a metal plate for example, with a flattened front surface for addressing the golf ball. The planar passageway 11 describes an arc generally facing the flattened surface and has an expanded reservoir 12 at the heel end 7 of the head, below hosel 24, and another expanded reservoir 14 at the toe end of the club with an intermediate restricted dimension throat. As further seen from FIG. 3, the heel reservoir 12 is aligned with the shaft through an imaginary vertical plane parallel to the front surface and the toe reservoir 14 is located adjacent the front surface forwardly of the imaginary plane.

As shown in FIG. 1 the passageway 11 is inclined by an angle $\alpha$ from horizontal to cause the charge of mercury 10 to tend to flow by force of gravity toward the heel reservoir 12. In some clubs a balance weight 20 of metal such as lead may be desired to give proper weight and balance to the driver.

As shown in FIG. 4, a golfer 21 with a driver swings a club in an arc 22 to address a ball at the mid-swing position shown, when the speed of the club is greatest. Because of the torque developed in this swing the mercury in the head will tend to pass from the heel reservoir 12 to the toe reservoir 14 as indicated by comparing the $x$ notation in the phantom views at each end of the swing with that at the ball addressing midswing position.

The dimensions of the throat, reservoirs mercury charge, arc configuration and position in the club may be chosen to fit the balance and counter-torque action desired for any particular swing speed or weight of club. It is convenient to provide as shown in FIGS. 2 and 3, the passageway 11 as a groove in the lower club portion 6 of plastic or laminated wood so that the club is readily assembled and may use different passageway configurations, where different torque conditions are encountered. Preferably an embodiment of the nature shown in FIGS. 2 and 3 is used to maintain the mercury in the region of the heel reservoir 12 during the backswing and shifting toward the toe reservoir during substantially 35% of the forward swing.

The mercury embodiment is preferable because of the high weight and speed at which it responds to the torque of the swing. The action of the mercury in passing from the heel to toe of the head during the swing is to counter the torque of the swing that otherwise tends to twist the head so that it does not address the ball squarely. Thus, the burden on the golfer to coordinate rhythm and tempo of the swing and to compensate by control of the club by the grip during the swing is substantially reduced. Accordingly, a golfer has better feel and control of the club and more consistently addresses the ball squarely.

The shifting mercury charge will in substance enlarge the hitting area of the club face, affording a square drive impact in addition to reducing the twist tendency on the shaft due to the torque of the swing. Any slight twist of the shaft at the address position would otherwise confine the impact "sweet spot" to a balance or pivot point at which a square address would result with a torque inflicted twisting of the shaft. Accordingly, this invention affords a larger area "sweet spot" where the ball may be addressed by the driver.

What is claimed is:

1. A golf club comprising in combination a shaft, a head having a hosel, a toe most remote from the shaft and a heel adjacent the shaft and below said hosel, said head having upper and lower sections affixed together and being aligned on said shaft with a flattened front surface for addressing a golf ball during a golfer's swing, and movable means located solely within the lower section of said head which changes position and therefore the center of gravity of the head during a golf club swing, wherein the movable means comprises a charge of mercury confined in a passageway within said lower section of the head, said passageway being planar and having two end reservoirs located respectively in said toe and heel and an intermediate restricted dimension throat, said heel reservoir being aligned with said shaft through an imaginary vertical plane parallel to said front surface and with said toe reservoir being located adjacent said front surface forwardly of said imaginary plane, said passageway describes an arc generally facing said flattened surface wherein the movable means is therefore, so oriented to move from a position substantially in line with the shaft during the back-swing to a position nearer the toe of the head during substantially 35% of the foward swing.

2. A club as defined in claim 1, wherein the passageway is inclined from a plane horizontal to the ground when the head is in a position to address the ball, with the uppermost position in the toe area of the head most remote from the shaft and the lowermost position substantially in line with the shaft, to thereby tend to hold the mercury in the shaft position by gravity until forced into the toe region by the torque of a golfer's swing.

* * * * *